US007517136B2

(12) United States Patent
Marrazzi et al.

(10) Patent No.: US 7,517,136 B2
(45) Date of Patent: Apr. 14, 2009

(54) DEVICE FOR CONTROLLING THE CLAMPING OF A CONTAINER OF FLUID PRODUCTS IN A MIXING MACHINE

(75) Inventors: Umberto Marrazzi, Medolla (IT); Umberto Richichi, Casinalbo (IT)

(73) Assignee: CPS Color Equipment S.p.A., San Felice S/Panaro (MO) (IT)

( * ) Notice: Subject to any disclaimer, the term of this patent is extended or adjusted under 35 U.S.C. 154(b) by 202 days.

(21) Appl. No.: 10/486,287

(22) PCT Filed: Jul. 22, 2002

(86) PCT No.: PCT/IB02/02979

§ 371 (c)(1),
(2), (4) Date: Apr. 9, 2004

(87) PCT Pub. No.: WO03/028873

PCT Pub. Date: Apr. 10, 2003

(65) Prior Publication Data

US 2004/0202045 A1 Oct. 14, 2004

(30) Foreign Application Priority Data

Aug. 10, 2001 (IT) ..... BO2001A0516

(51) Int. Cl.
*B01F 11/00* (2006.01)

(52) U.S. Cl. ..... 366/209

(58) Field of Classification Search ..... 366/110–111, 366/114, 208–211, 219, 605
See application file for complete search history.

(56) References Cited

U.S. PATENT DOCUMENTS

| | | | | |
|---|---|---|---|---|
| 4,134,689 | A * | 1/1979 | Ahrenskou-Sorensen | 366/110 |
| 4,588,302 | A * | 5/1986 | Pizzi et al. | 366/349 |
| 4,842,415 | A * | 6/1989 | Cane et al. | 366/110 |
| 5,066,136 | A * | 11/1991 | Johnson | 366/209 |
| 5,197,802 | A * | 3/1993 | Miller et al. | 366/217 |
| 5,261,744 | A * | 11/1993 | Brunn | 366/217 |
| 5,268,620 | A * | 12/1993 | Hellenberg | 318/114 |
| 5,310,257 | A * | 5/1994 | Altieri et al. | 366/208 |
| 5,462,353 | A * | 10/1995 | Gatlin | 366/209 |
| 5,662,416 | A * | 9/1997 | Dwigans, II | 366/209 |

(Continued)

FOREIGN PATENT DOCUMENTS

EP 0317112 A1 * 5/1989

(Continued)

OTHER PUBLICATIONS

Derwent Abstract for EP 681864A1.*

(Continued)

*Primary Examiner*—Charles E Cooley
(74) *Attorney, Agent, or Firm*—Birch, Stewart, Kolasch & Birch, LLP

(57) ABSTRACT

A device for clamping a contained in a mixer for fluids comprises a clamping unit selectively operable for clamping a container by the application of compressive forces. Resilient compression members and a sensor are associated with the clamping unit for detecting the application of a predetermined clamping force to the container by determination of the deflection of the resilient compression member proportional to the predetermined clamping force.

8 Claims, 6 Drawing Sheets

U.S. PATENT DOCUMENTS

| | | | | | |
|---|---|---|---|---|---|
| 5,711,601 | A * | 1/1998 | Thomas et al. | 366/209 |
| 5,749,652 | A * | 5/1998 | Brunn et al. | 366/209 |
| 5,897,204 | A * | 4/1999 | Dittmer et al. | 366/209 |
| 5,904,421 | A * | 5/1999 | Mazzalveri | 366/213 |
| 5,906,433 | A * | 5/1999 | Mazzalveri | 366/209 |
| 6,318,889 | B1 * | 11/2001 | Hansen, Sr. | 366/286 |
| 6,827,480 | B2 * | 12/2004 | Morselli | 366/209 |
| 6,850,020 | B1 * | 2/2005 | Midas et al. | 318/286 |
| 6,883,955 | B2 * | 4/2005 | Salas et al. | 366/110 |
| 7,311,437 | B2 * | 12/2007 | Midas et al. | 366/217 |
| 7,344,300 | B2 * | 3/2008 | Midas et al. | 366/209 |
| 2004/0008573 | A1 * | 1/2004 | MacDonald et al. | 366/209 |
| 2004/0013031 | A1 * | 1/2004 | Salas et al. | 366/141 |
| 2004/0100863 | A1 * | 5/2004 | Morselli | 366/209 |
| 2004/0202045 | A1 * | 10/2004 | Marazzi et al. | 366/209 |
| 2005/0169102 | A1 * | 8/2005 | Manke | 366/209 |

FOREIGN PATENT DOCUMENTS

| | | | |
|---|---|---|---|
| EP | 0 681 864 | A1 | 11/1995 |
| EP | 0680778 | A1 * | 11/1995 |
| EP | 0796652 | A1 * | 9/1997 |
| EP | 1114673 | A2 * | 7/2005 |
| JP | 10-216498 | * | 9/1998 |
| WO | 03/028872 | A1 * | 4/2005 |

OTHER PUBLICATIONS http://web.archive.org/web/20010312063106/www.chameleon.ie/hsm-35 l.html
Owner's Manual - Rev 000, HSM 35, High Speed Automatic Paint Shaker (D3).

* cited by examiner

DEVICE FOR CONTROLLING THE CLAMPING OF A CONTAINER OF FLUID PRODUCTS IN A MIXING MACHINE

FIELD OF THE INVENTION

The present invention relates to the field of mixing machines for mixing fluid products such as, for example, paints, varnishes, enamels and the like, placed inside closed containers. In particular, the invention was developed with reference to a device for controlling the clamping of containers such as, for example, tins, cans or drums, on the above-mentioned mixing machines.

DESCRIPTION OF THE RELATED ART

The mixing machines of known type generally comprise a main support structure, and a frame connected movably with respect to the main structure for imparting a mixing motion to a container of fluid products. Fixed to the frame is a clamping unit comprising, for example, a pair of clamping plates for supporting and clamping the container. Each or both of the plates is or are selectively movable towards and away from each other by means of a mechanical transmission operated by an electric motor.

The technical characteristics of the main support structure vary according to the type and model of mixing machine on which the aforesaid structure is mounted, and in particular according to the mixing motion imparted, in use, to the container, whether a gyroscopic, rotatory, shaking or vibratory motion, or a combination of rotatory and vibratory motion.

During the process of mixing a fluid product, the containers are first clamped between the pair of plates by the application of a clamping force, and then subjected to a motion of the type indicated above, such that the various fluid product components are thoroughly amalgamated with one another. Since the containers filled with fluid product may be of significant dimensions and weight, it is clear that during mixing they may exert thrusts and inertial forces such as to interfere with the clamping force applied and, sometimes, to cause accidental opening or loosening of the clamping plates. The clamping force of the plates on the container must therefore be strong enough to oppose the dynamic thrusts which are generated during the mixing phases, but cannot be arbitrarily high since otherwise there would be a risk of crushing the containers.

The principal problem of the mixing devices of known type is that of succeeding in applying and maintaining at all times the necessary and correct clamping pressure on the container to be mixed. This means that for correct operation of the mixer it is necessary to determine that the clamping devices have reached the necessary clamping force and, principally, to keep such a force applied during the whole of the mixing process. On this subject there are numerous documents of the prior art which illustrate various different types of solution aimed at solving this problem.

The same Applicant has conducted varied studies and research in order to test the efficacy of the control of the clamping of a container on a mixing machine for fluids. However, the tests carried out showed that frequently, and especially in the case of mixing large quantities of fluid product, contained in tins of significant dimensions, all the solutions of known type give unsatisfactory results. The devices of known type are generally complex, being characterised by delays in the response times, or inaccurate in determining the clamping step.

For example, U.S. Pat. No. 5,268,620 describes a system for controlling the clamping force for clamping the plates in a clamping unit for mixing machines for fluid products, in which the current absorbed by the electric motor, which effects the rotation of screws for controlling the plates between which the container of fluid products is clamped, is detected and measured. The main drawback of such a system lies in the fact that the current absorbed by the electric motor also depends on factors other than the effective clamping force exerted by the plates on the container. For example, in the case where the screws for controlling the clamping plates become dirty, the force required to move the plates is greater because of the greater friction encountered. Such a situation may lead to false indications and to erroneous signalling that a sufficient clamping force on the container has been reached.

In European Patent EP 0 681 864, well known to the Applicant, a gyroscopic mixer is illustrated, comprising a pair of clamping plates, for supporting and clamping a container, which are selectively movable towards and away from each other. The upper clamping plate is supported by a spring, the complete compression of which, during the step of clamping the container, contributes to disabling a sensor which interrupts the clamping action of the two plates and actuates the mixing step. The device illustrated in EP 0 681 864, comprising the upper plate, the spring and the sensor, is used as a detector for detecting the presence of a container within the clamping plates, and performs a simple on/off switch function. One of the main drawbacks of this device consists in the total absence of control of the clamping force applied during the phase of mixing of the container, which represents the most critical phase in the operation of a mixer.

BRIEF SUMMARY OF THE INVENTION

An aim of the present invention is that of remedying the drawbacks of the devices of known type. In particular, the aim is that of providing a simple and effective device which guarantees, in any operating state of the mixing machine, and therefore also during the actual mixing phases, a correct indication of the real state of clamping of the containers of fluid products.

Another aim of the invention is that of providing a device which is economic, reliable over time and easy to manufacture, assemble and maintain.

A further aim of the present invention is that of producing a control device which uses the least possible number of electrical measuring components, simplifying the control logic circuits and reducing any possible errors in the relative response times.

In order to fulfil the above-mentioned aims, the subject of the invention is a device for clamping a container in a mixer for fluids, comprising at least one clamping unit selectively operable for clamping, in use, at least one container by the application of compressive forces, and sensor means associated with the clamping unit for detecting the application of a predetermined clamping force to the at least one container, characterised in that the clamping unit comprises one or more resilient compression members, the sensor means detecting the deflection of said one or more resilient compression members proportional to the predetermined clamping force.

According to an additional characteristic, the clamping unit of the present invention also comprises an end of travel device which makes it possible to interrupt the action of the motor means when the clamping unit reaches the end of its travel. One of the advantages of this additional, characteristic is that of improving the control of the clamping devices of the present invention and avoiding situations of incorrect operation of the entire mixing machine.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further characteristics and advantages will become clear from the following description of a preferred embodiment, with reference to the appended drawings, provided by way of non-limiting example, in which.

DETAILED DESCRIPTION OF THE INVENTION

Figure 1:
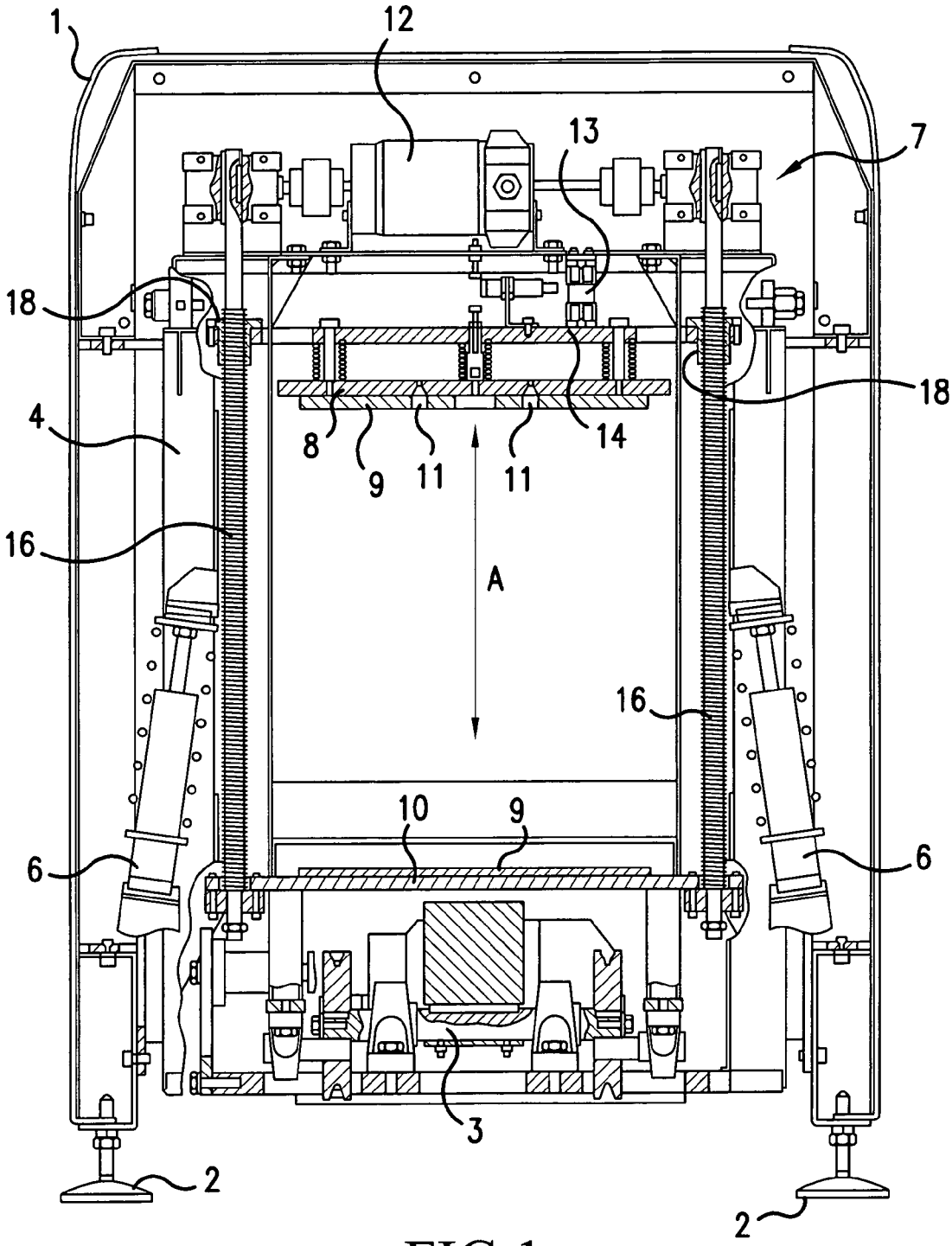
FIG. 1 is a view in longitudinal section of a mixing machine comprising a clamping device according to the present invention.

With reference now to FIG. 1, a mixing machine, of known type, comprises a main support structure 1 having a plurality of support feet 2, for example, but not by way of limitation, adjustable in height. A frame 4 is resiliently suspended on the support structure 1 by resilient means, for example, but not by way of limitation, suspensions 6, and is mechanically connected to a main movement unit 3 which is actuated, in use, in order to impart to the frame 4 the movement necessary for mixing the fluid product.

To the frame 4 there is fixed a clamping unit 7 comprising a pair of clamping means, for example, clamping plates 8, 10, selectively movable towards and away from each other by means of a mechanical transmission operated by a second motor unit 12. In the example in the drawings, the lower plate 10 is fixed, while the upper plate 8 is connected to thrust means, for example, but not by way of limitation, a transverse member, and preferably a transverse plate 14 movable in the direction of the arrows A.

The transverse plate 14 is coupled by means of screw-threaded bushes 18 to control screws 16 operable in rotation by the second motor unit 12 which can be actuated selectively, in use, to effect the lowering or raising of the upper plate 8 in the direction of the arrows A.

The system for moving the transverse plate 14, and the system for moving the frame 4 for the mixing of the fluid product, are of a generally known type and will not therefore be further discussed in detail.

The clamping unit 7 illustrated in the drawings is particularly adapted to use in mixing machines of the shaking or vibratory type. The characteristics of the invention described below, with reference to the particular embodiment illustrated, may of course be adapted with the minimum of variants also to a clamping unit for mixing machines of a different type, such as, for example, to the clamping unit of mixing machines of the gyroscopic type, in which normally both the lower and upper plates are movable, or to the clamping units of the mixing machines described in documents EP-0617998 and EP-0706820 of the same Applicant, in which a plate is simultaneously movable along a vertical axis and rotatable about the same.

To the upper clamping plate 8 there is preferably fixed a non-slip layer 9, for example, a mat of rubbery material connected by means of a plurality of screws 11 to the upper clamping plate 8. The mat 9 directly faces towards the lower plate 10 in order to improve, in use, the engagement of the upper clamping plate 8 with, and adherence to, the lid of the container of fluid products. Analogously, a similar non-slip layer 9 may be fixed to the lower plate 10.

Figure 2:
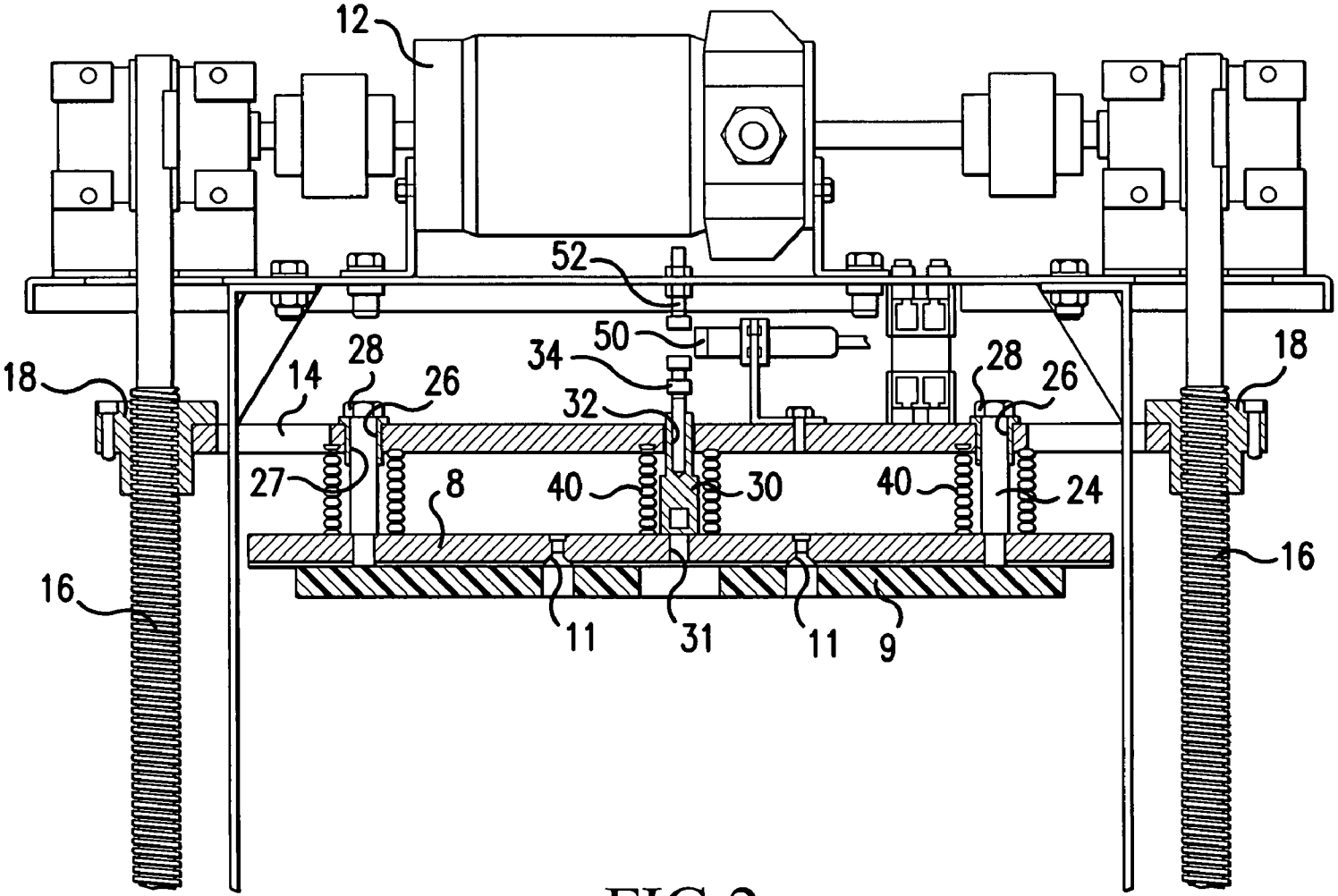
FIG. 2 is an enlarged view of the clamping unit of the present invention.

With particular reference to FIG. 2, the upper plate 8 is mounted so as to float movably on the transverse plate 14 by means of one or more connection means, for example, but not by way of limitation, elongated pins 24. The pins 24 are fixed to the upper plate 22, for example by means of a screw-threaded connection, and slidingly pass through respective apertures 26 provided on the transverse plate 14.

Figure 5:
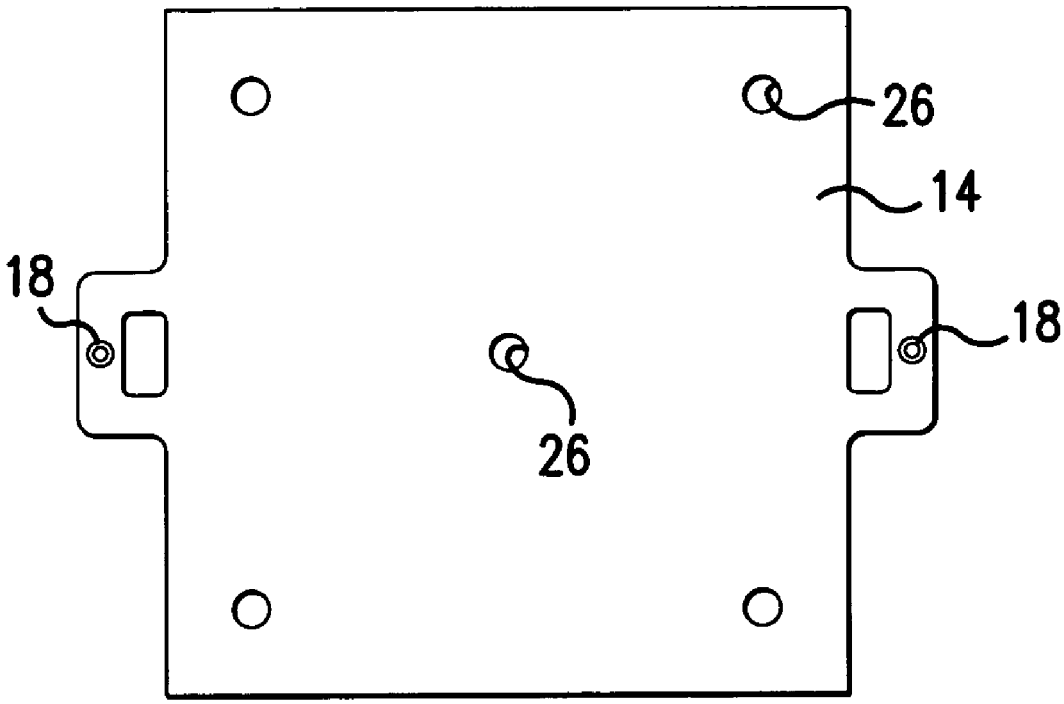
FIG. 5 is a view from above, according to the arrow V in FIG. 2, of a support structure for the upper clamping plate.

In the preferred embodiment illustrated, on the transverse plate 14 are provided five apertures 26 disposed in an X-shape, as can be seen in FIG. 5. The type and number of the connection means and the arrangement of the apertures may of course vary with respect to what has been indicated as also may the form of the thrust means, without preventing the aims and advantages of the present invention from being fulfilled and obtained.

Figure 3:
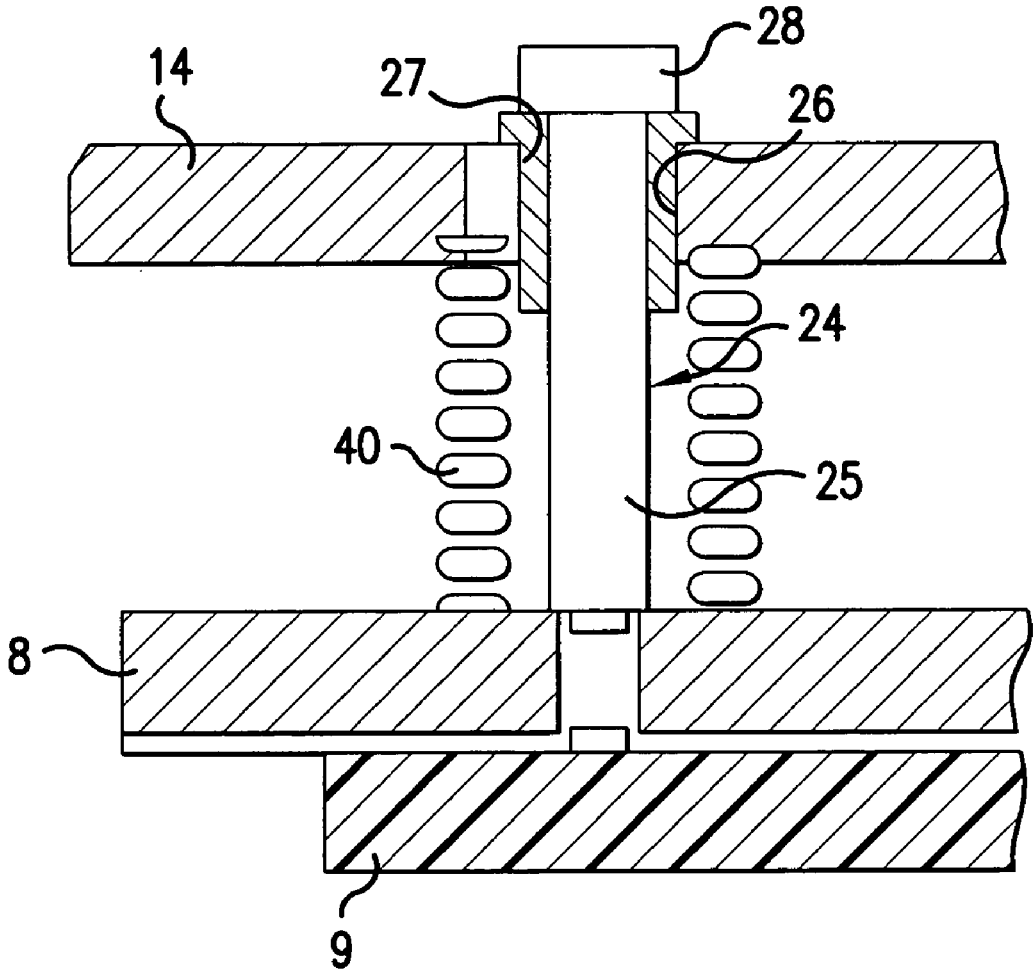
FIG. 3 is a sectional view of a detail of the clamping unit illustrated in FIG. 2.

With reference now to FIG. 3, the pins 24 comprise a shank 25 and a bead 28 which, in a rest state of the mixing machine such as that illustrated in FIG. 2, abuts on a bush 27 inserted inside each aperture 26 of the transverse plate 14. In this position the plate 14 is capable of supporting the upper plate 8 at a predetermined maximum distance, substantially equal to the length of the pins 24. Between the transverse plate 14 and the upper clamping plate 9 are inserted resilient members 40 described in more detail below.

Figure 4:
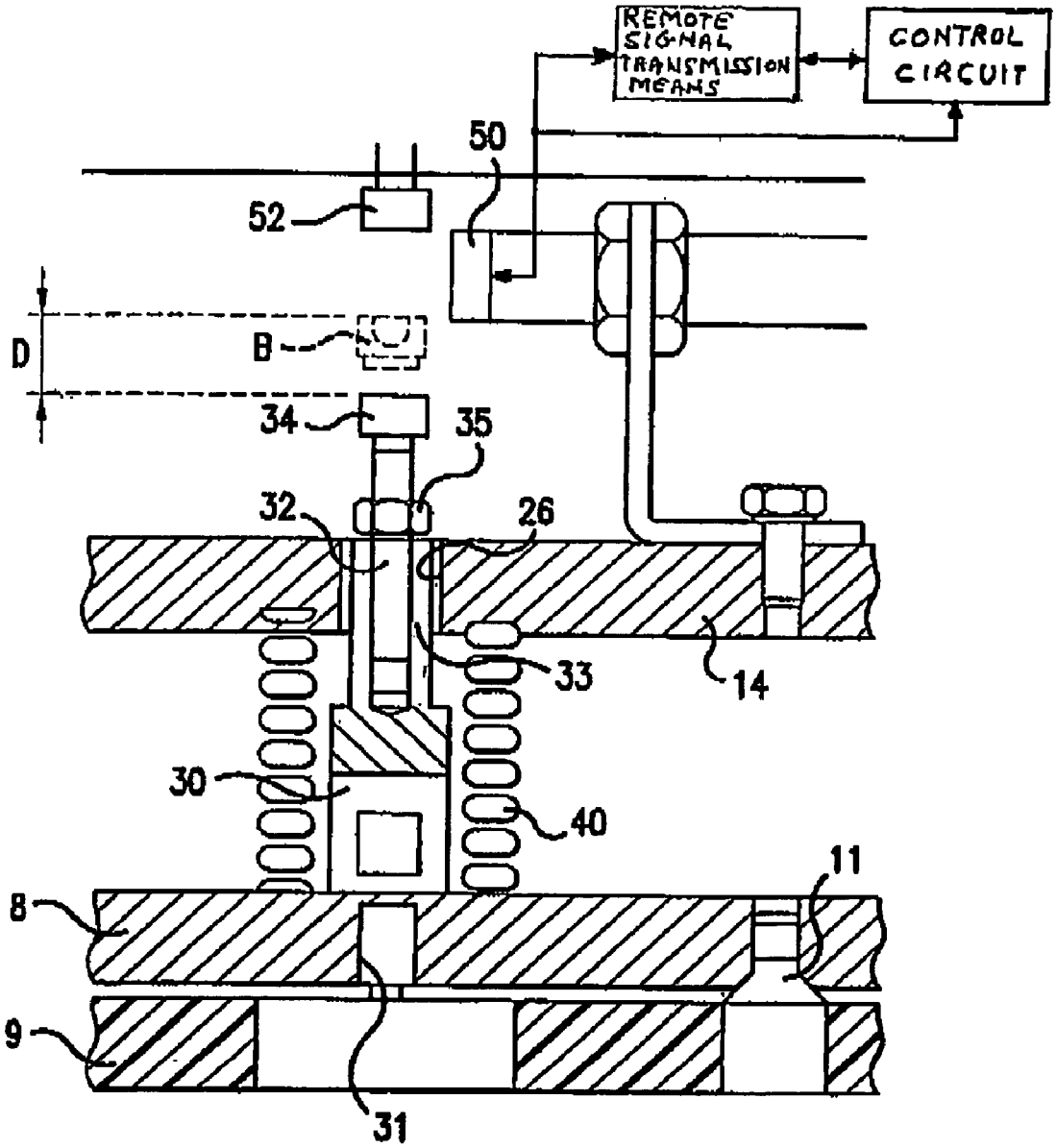
FIG. 4 is a sectional view of a detail of the clamping unit of FIG. 2 illustrating sensor means.

As illustrated in FIG. 4, a guide pin 30 is connected to the upper plate 8, preferably in a central region thereof, for example, but not by way of limitation, by means of a screw 31. A cylindrical portion 33 of the guide pin 30 slides inside the central aperture 26 of the transverse plate 14. From the upper end of the guide pin 30 protrudes a screw 32 screwed into a threaded hole provided in the guide pin 30. The screw 32 comprises a head 34 which protrudes at the top with respect to the surface of the transverse plate 14 to a predetermined distance, adjustable, as will become clearer hereinafter, by means of its threaded connection with the guide pin 30. The screw 32 is clamped on the guide pin 30 by means of a lock nut 35.

Between the upper plate 8 and the transverse plate 14, as mentioned above, one or more resilient means are disposed, for example, but not by way of limitation, resilient compression members, preferably helical springs 40 of the type for punches, disposed preferably, but not necessarily, coaxially with respect to the pins 24, 30. The springs 40, in use, make it possible to associate the upper plate 8 resiliently with the transverse plate 14, but above all to oppose resiliently any movement of the upper plate 8 towards the transverse plate 14.

The principal function of the resilient compression members of the present invention is that of developing, in use, a compressive force, distinct from but dependent on the clamping force exerted by the clamping plates, on the upper plate a and consequently on the container of fluid products. Such a characteristic is of particular advantage during the mixing phase, in so far as through the variations in the intensity of the compressive force exerted by the resilient members, that is to say, through their deflection, it is possible to monitor the stress forces exerted by the container on the clamping plates. As a result of this control action, the resilient compression members of the present invention can be likened in their operation to transducer elements capable of providing, at any moment, information regarding the dynamic states of the container subjected to mixing.

In the light of the above it is possible, for example, to preload the springs 40 to a greater or lesser degree on the basis of the type of mixing machine and its use, so as to predetermine the necessary force which must be applied and maintained by the clamping unit during the clamping and mixing phases.

Moreover, according to a variant of the present invention, the resilient means may comprise resilient means known as "silentbloc". The technical characteristics of these resilient means make it possible to keep the elastic absorption constant even when the clamping forces develop in a substantially non-vertical direction with respect to the transverse plate 14.

In the central region of the transverse plate 14 there is also fixed a sensor, preferably a proximity sensor. The sensor 50 is connected to a control system (not shown) which controls the operation of the clamping unit 7 of the mixing machine and, in particular, the selective interruption of the clamping devices during the step of clamping a container of fluid products. Guide means for cables, for example a flexible guide 13, are mounted between the frame 4 and the transverse plate 14 to receive the connecting cables from the sensor 50 to the control system.

When using particular types of mixing machines such as gyroscopic mixing machines, whenever the transverse plate 14 on which the proximity sensor 50 is connected must have a general capacity for rotation with respect, to the main structure 1 on which the control system is mounted, it is possible to use an electrical connection between the sensor 50 and the control system which employs, instead of conductor wires, sliding contacts or uncoupled means for the transmission of electrical signals, such as optical or radio transmission and receiving systems, or other types known to experts in the field.

Another particularly advantageous characteristic of the present invention comprises an end of travel device which provides the mixing machine with a further level of safety in the automatic control of the clamping unit 7. As illustrated in FIG. 4, the clamping device comprises a screw 52 fixed in the upper portion of the frame 4, disposed facing towards the transverse plate 14 and coaxial with the central region of the transverse plate 14.

As mentioned previously, when a mixing machine of the type described above is in operation, the clamping force applied to the container of fluid product must oppose the thrusts and inertial forces exerted by the container on the clamping plates. The clamping force necessary may therefore be determined beforehand, in so far as it is substantially proportional to the mass of the container itself and to its velocity of motion In the present invention, in order to determine when the clamping devices have reached the necessary clamping force, and to ensure that such force remains applied during the whole of the mixing process, the properties of the resilient means mentioned above are employed.

In a resilient means, for example, but not by way, of limitation, a spring, the deflection represents the yielding which, under the action of a specific force, the spring exhibits in the direction of the force. Within the limits of elasticity, the deflection of the spring and the load applied thereto are proportional. In particular:

$$P=k*r$$

wherein P is the load, k is the coefficient of proportionality which represents the load capable of producing the unitary deflection, and r is the deflection. The coefficient k is sometimes termed rigidity or elastic constant of the spring.

By exerting a progressive compressive force on a spring it is possible to detect, by measuring the deflection, the value of the load applied. In particular, on reaching a predetermined deflection, the load will in its turn assume a predetermined value.

In the phase of calibration of a clamping device according to the present invention, once the clamping force which it is wished to apply to a specific container of fluids has been determined, and the elastic coefficient of the resilient means used being known, it is sufficient to determine the deflection of the resilient means necessary to reach such a load, and therefore the approach of the upper plate 8 with respect to the transverse plate 14. On the basis of the desired approach value, the height of the screw 32 with respect to the transverse plate 14 is adjusted, and consequently its distance D in the rest state from the sensor 50, by means of its threaded connection, in order to establish when to interrupt the application of the compressive forces. By modifying the height of the screw 32 at any moment, therefore, it is possible to modify the clamping force applicable to the container.

During the use of the mixing machine, when a container of fluid products to be mixed is placed on the lower plate 10, the second motor unit 12 is actuated to bring about the lowering of the upper plate 8 towards the upper face of the container. When the upper plate 8, by way of the mat 9, comes into contact with the lid of the container of fluid products, the continued action of the motor unit 12 effects progressive clamping of the container, with the gradual compression of the springs 40. At the same time, as a result of the vertical effort exerted by the transverse plate 14 and of the reaction force exerted by the container on the upper plate 8, the upper plate 8 gradually approaches the transverse plate 14. This movement brings about the approach of the head 34 of the screw 32 towards the sensor 50.

When the head 34 of the screw 32 is in the position B, in proximity to the sensor 50, as illustrated in FIG. 4 by dashed lines, the upper plate 8 has approached the transverse plate 14 by a specific distance, corresponding to the deflection of the springs 40 which coincides with the reaching of the desired force applied to the container. In such a position, the sensor 50 sends a signal to the control system, which is interpreted as a signal indicating correct clamping of the container of fluid products. This signal contributes, together with the signals coming from any other sensors present in the mixing machines of known type, to the general verification of the correct readiness for use of the mixing machine and to the subsequent consent for the execution of the actual mixing phase.

During the mixing phase, maintaining the head 34 in the position B, in proximity to the sensor 50, and the consequent presence of the signal indicating correct clamping of the container, allow the mixing machine to continue its normal operation.

Still in this phase, however, the frame 4, and consequently the clamping unit 7, are subjected to significant thrusts and inertial forces due to the mixing motion of the container of fluid products. Such stresses interfere with the clamping force applied and sometimes may cause accidental displacement of the upper clamping plate 8 from its correct position, as a result, for example, but not by way of limitation, of a loosening of the threaded coupling between the threaded bushes 18 and the control screws 16.

In such an eventuality, a reduction in the reaction force exerted by the container would allow the compressive force exerted by the springs 40 to move the upper plate 8 away from the transverse plate 14, resulting in lowering of the head 34 with respect to the sensor 50, so as to interrupt the actuation of the signal indicating correct clamping. The control system interprets this state as a lack of the necessary clamping force, and proceeds to actuate the motor unit 12 to clamp the upper plate 8 on the container again. The action of restoring the conditions of correct loading on the springs 40 continues until the head 34 is again in proximity to the sensor 50 and the control system receives the actuation signal from the sensor 50.

This characteristic of verifying the load applied to the container during the mixing operations represents an additional control for improving the overall safety of operation of the mixing machine.

A further particularly advantageous additional control of the present invention consists in the possibility of implementing in the control system a safety procedure to be actuated following the action of restoration of the conditions of correct loading on the springs 40 described above. In such a situation, in fact, after the actuation of the motor unit 12, the control system actuates a timing element. If, within a predetermined time interval, for example, but not by way of limitation, around 200 milliseconds, the sensor 50 does not send an actuation signal to the control system, the latter proceeds to interrupt the operation of the mixing machine. This procedure is used to signal probable crushing of the container or, in any case, to avoid useless overloading of the motor unit 12 due, for example, to incorrect functioning of the resilient compression members, or of the sensor or of the clamping unit in general.

At the end of a mixing phase, the upper plate 8 is returned to its rest state, by raising the transverse plate 14 towards the upper portion of the frame 4. In the case where the end of travel device 52, described above, is also provided, the approach of the sensor 50 to the screw 52 actuates a signal which, when detected by the control system, is interpreted as an end of travel signal. The control system therefore disables the motor unit 12 while awaiting a further clamping step.

The principal advantage of this characteristic is that of using the same proximity sensor 50 employed to detect the application of a predetermined clamping force, so as to reduce the number of electronic components of the mixing machine and consequently simplify its control logic. This characteristic also allows a noticeable reduction in the production costs and easier maintenance of the present invention.

Figure 6:
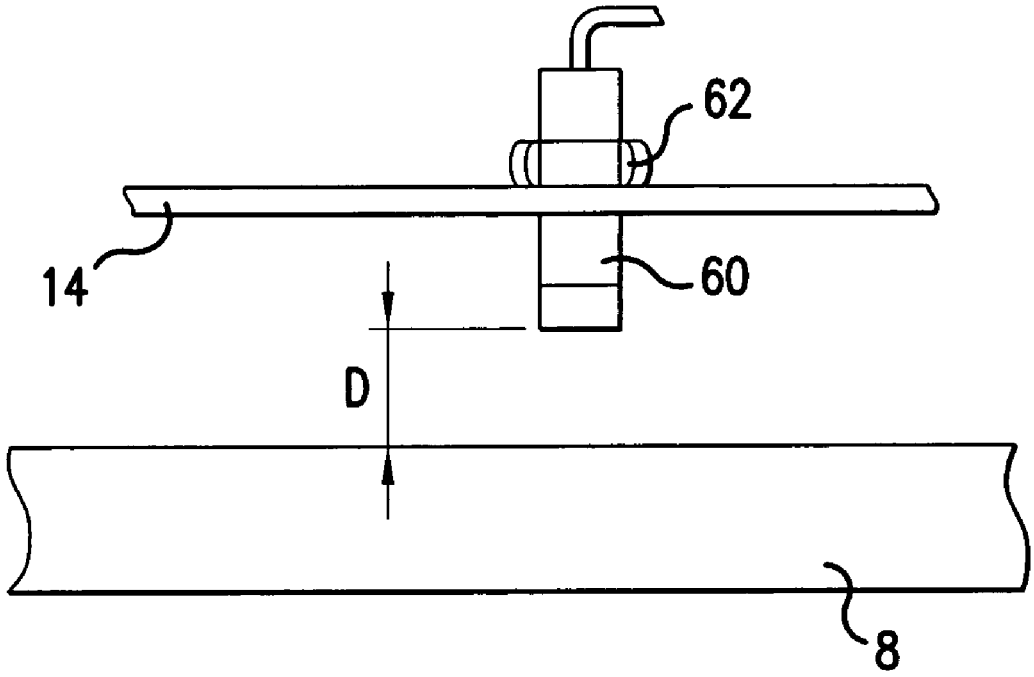
FIG. 6 is a diagrammatic sectional view of a further embodiment of the sensor means.

In an alternative embodiment of the sensor means of the present invention, illustrated in FIG. 6, a sensor element, for example a capacitive sensor 60, is engaged with the transverse plate 14, for example by means of a lock nut 62, and disposed facing towards the upper plate 8 at a distance D in the rest state. The capacitive sensor 60 is capable, in use, of emitting a signal proportional to the approach of the upper plate 8 to the transverse plate 14 so as to determine, at any moment, the force applied to the container. In this case also, on the basis of the desired approach value, and therefore on the basis of the clamping force which it is wished to apply to the container, the height of the sensor 60 with respect to the upper plate 8, and consequently its distance D in the rest state, can in any case be adjusted.

With the principle of the invention remaining the same, the embodiments and the details of production may of course vary widely with respect to what has been described and illustrated, without thereby departing from the scope of the present invention.

The invention claimed is:

1. A device for clamping a container in a mixer for fluids, comprising at least one clamping unit selectively operable for clamping, in use, at least one container by the application of compressive forces, and sensor means associated with said clamping unit for detecting the application of a predetermined clamping force to said container, wherein said clamping unit comprises one or more resilient compression members adapted, in use, to exert a compressive force, wherein said sensor means is able to detect the deflection of said one or more resilient compression members to reach a predetermined position, the deflection determining said predetermined clamping force, since the deflection of the resilient compression members is proportional to clamping force wherein said claimping unit further comprises at least two opposed clamping plates movable with respect to one another for clamping said container, and wherein one of said two clamping plates is resiliently connected to a transverse member by the insertion of at least one of said resilient compression members wherein said sensor means comprise at least one sensor for detecting said predetermined position of said clamping plate to said transverse member.

2. A device according to claim 1, wherein the deflection of said resilient compression members proportional to said predetermined clamping force corresponds to a predetermined position of said clamping plate in relation to said transverse member.

3. A device according to claim 1, wherein said at least one sensor is connected to a control circuit for selectively actuating or disabling said clamping unit at said predetermined position.

4. A device according to claim 3, wherein the connection between said at least one sensor and the control circuit is produced by means of a remote signal transmission.

5. A device according to claim 1, further comprising an end of travel device associated with said clamping unit, adapted, in use, for detecting an end of travel of said transverse member.

6. A device according to claim 5, wherein said end of travel device comprises a proximity sensor.

7. A device for clamping a container in a mixer for fluids, comprising at least one clamping unit selectively operable for clamping, in use, said container by the application of compressive forces, and sensor means associated with said clamping unit for detecting the application of a predetermined clamping force to said container, wherein said clamping unit comprises two opposed clamping plates and one or more resilient compression members adapted, in use, to exert a compressive force, wherein said sensor means is able to detect the deflection of said one or more resilient compression members to reach a predetermined position, the deflection determining said predetermined clamping force since the deflection of the resilient compression is proportional to the clamping force, wherein said two opposed clamping plates comprises a lower plate supporting said container and an upper plate selectively movable for applying said compressive force to said container, said upper plate being associated with a transverse member by means of the insertion of one or more of said resilient compression members, and wherein said sensor means is connected to said transverse member and comprises at least one proximity sensor for detecting, in use, a predetermined position of said upper plate with respect to said transverse member.

8. A method for controlling the clamping of a container of fluid products in a mixer for fluids of the type comprising at least one clamping unit selectively operable for clamping, in use, said container by the application of compressive forces, wherein said method comprises the following steps:

arranging said container of fluid products inside said mixer;

providing resilient compression means associated with said clamping unit;

actuating said clamping unit for clamping said container by the application of compressive forces to said resilient means;

detecting the deflection of said resilient means to reach a predetermined position, the deflection being determining a predetermined clamping force;

actuating said mixer for initiating a mixing cycle, and;

detecting the deflection of said resilient means and thus the forces exerted by said container on said clamping unit.

* * * * *

UNITED STATES PATENT AND TRADEMARK OFFICE

CERTIFICATE OF CORRECTION

PATENT NO. : 7,517,136 B2
APPLICATION NO. : 10/486287
DATED : April 14, 2009
INVENTOR(S) : Umberto Marazzi et al.

It is certified that error appears in the above-identified patent and that said Letters Patent is hereby corrected as shown below:

The first inventor's last name is misspelled:

Title Page, Item (75) should read

-- Inventors: Umberto Marazzi, Medolla (IT);
Umberto Richichi, Casinalbo (IT) --

Signed and Sealed this

Nineteenth Day of January, 2010

David J. Kappos

David J. Kappos
*Director of the United States Patent and Trademark Office*